United States Patent [19]

Gosis

[11] Patent Number: 4,720,938

[45] Date of Patent: Jan. 26, 1988

[54] DRESSING FIXTURE

[75] Inventor: Anatoly Gosis, Chicago, Ill.

[73] Assignee: General Signal Corp., Stamford, Conn.

[21] Appl. No.: 891,376

[22] Filed: Jul. 31, 1986

[51] Int. Cl.[4] ..... B24B 7/00

[52] U.S. Cl. ..... 51/131.1; 125/11 DF

[58] Field of Search ..... 51/129, 131.1, 11 CD; 125/38, 11 DF, 131.2, 131.3

[56] References Cited

U.S. PATENT DOCUMENTS 1,474,614 11/1923 Bartlett ..... 125/11 CD 2,688,215 9/1954 Roshong ..... 51/129

2,772,521 12/1956 Voytech ..... 51/129

3,662,498 5/1972 Caspers ..... 125/11 DF

*Primary Examiner*—Harold D. Whitehead

[57] ABSTRACT

A fixture for dressing the polishing surfaces of a platen to maintain it in a planar condition, including a flexible carrier which is adapted to be rotated independently of the rotation of the surface to be dressed, with the carrier providing an opening for the placement therein of a dressing pad. About the edges of the opening there are provided a plurality of driving keys which will engage appropriate edge surfaces of the dressing pad for effecting rotation of the dressing pad with the flexible carrier relative to the surface to be dressed.

1 Claim, 4 Drawing Figures

DRESSING FIXTURE

GENERAL BACKGROUND

In polishing machines the essential planar condition of the annular polishing surface is required to be periodically dressed or reconditioned. This annular surface, after a long period of continuous use, becomes scratched or abraded and thus requires facial dressing to restore its planar surface to an operative condition.

It is an object of this invention to effect dressing of the annular surface of a rotatable platen by a highly effective driven dressing pad.

In the past polishing machines included dressing rings which were adapted to be driven in reverse of normal direction of the annular polishing surface of the rotatable platen and thus required special driving means as well as specially constituted rings and ring holders.

SUMMARY OF THE INVENTION

It is an object of this invention to provide a dressing fixture for polishing machines. The dressing fixture of this invention includes a reuseable dressing pad which may be made from stainless steel or any non-corrosive material, that provides on its opposite surfaces a pattern of cutting ridges or teeth which may be formed in either a single or double cut set.

To present the dressing pad onto the surface to be dressed there is provided a thin flexible carrier, the periphery of which provides gear-like teeth that are adapted to mate with stationary driving pins provided by the machine to be dressed. Formed within the periphery of the flexible carrier is a cutout or opening which will correspond to the configuration of the dressing pad. This carrier and dressing fixture assembly requires that the carrier be only slightly thinner than the fixture, to insure being captured therein for movement therewith.

In instances when there is a great discrepancy between the thinness of the flexible carrier and the dressing fixture, it is necessary to provide a series of driving keys carried by the carrier adjacent to the edge of the cutout or opening. These driving keys together with the flexible carrier will have a thickness less than that of the dressing pad but will provide adequate contact between the carrier and the dressing pad so that the latter is moved in a planarity motion relative to the surface being dressed.

BRIEF DESCRIPTION OF THE DRAWINGS

The invention will be best understood by reference to the accompanying drawings which illustrate the preferred form of construction by which the objects of the invention are achieved and in which.

GENERAL DESCRIPTION

In polishing machines of either the single or dual platen variety it becomes necessary to recondition or dress the surfaces of the rotatable platens. In order to do this I have provided a dressing fixture which may be used in either type of machine to effectively recondition the polishing surfaces thereof.

To accomplish the dressing and reconditioning operation I provide a flexible carrier 10 that may be made of thin material such that it can be easily flexed out of its normal plane. The periphery of the carrier 10 is formed to provide a series of gear-like teeth 11 which are adapted to engage stationary driving pins provided by the machine to be dressed. The machine which is to have its surface reconditioned or dressed will normally provide a center hub which constitutes a series of driving pins as well as an exterior ring of pins such that the flexible carrier is positioned therebetween with its gear teeth 11 engaged or meshed with such pins so as to effect the planar motion of the carrier and its dressing pad relative to the rotating surface to be dress.

Figure 1:
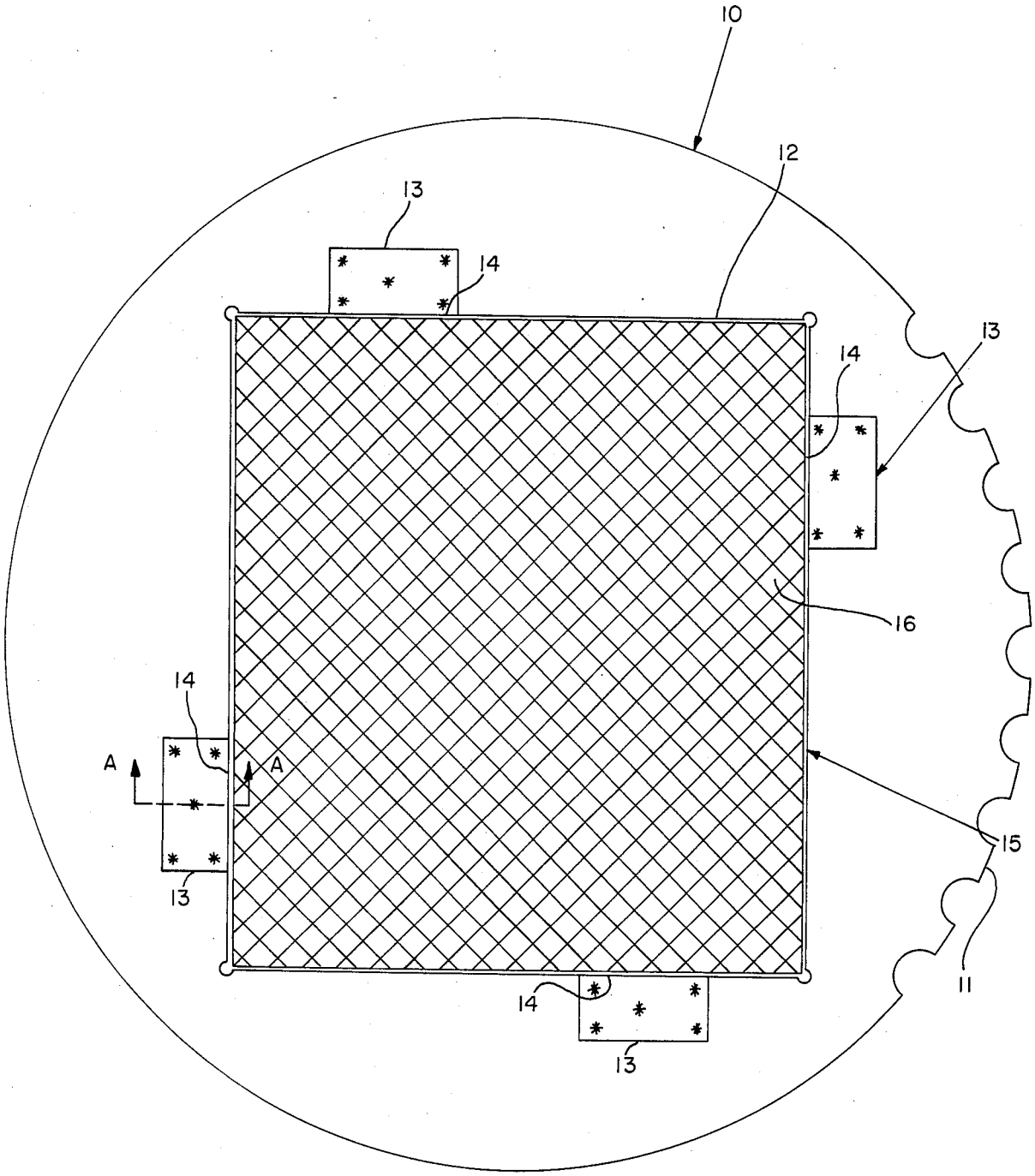
FIG. 1 is a top plan view of the dressing fixture and its carrier.
Figure 2:
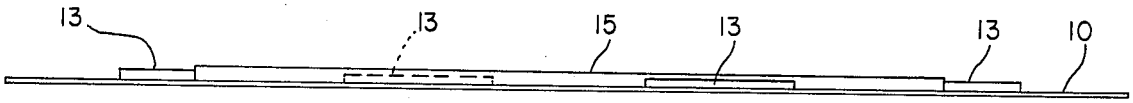
FIG. 2 is a side elevational view of the dressing fixture in its carrier.

As illustrated in the drawing the flexible carrier 10 provides an opening 12. This opening 12 may be of any configuration and is not restricted to the square as illustrated. Mounted on the surface of the carrier 10 systematically about the opening 12 are driving keys 13. These keys 13 present an edge 14 which is in alignment with the edge of the carrier 10 defining the opening 12 and combine therewith to present a thickened vertical face that is adapted to contact a corresponding edge portion of a dressing pad. A dressing pad 15 having an external configuration corresponding to the opening 12 formed in the carrier 10 is adapted to be placed within such opening 12 as shown in FIGS. 1 and 2 of the drawing. This dressing pad 15 is of a metallic material such as stainless steel, or other non-corrosive material and has its opposite surfaces provided with ridges or cuts that will present a file-like rasp surface. The pattern of the surface cuts 16 may take on any design that is suitable for the material to be dressed and thus it need not be cross hatched as shown but may comprise either a circular or spiral pattern and will function just as efficiently with such various designs.

Figure 3:
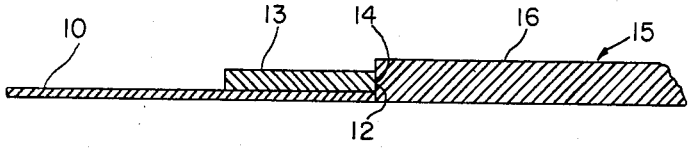
FIG. 3 is a fragmentary detailed sectional view taken on line a—a FIG. 1.

By reason of the required function of the dressing pad it is normally of a thickness greater than that of the carrier, and as such there is very little contact surface between the carrier and the dressing pad, thus the necessity of the driving keys. As seen in FIG. 3 the combined thickness of the driving key and carrier is just slightly less than that of the thickness of the dressing pad. By such a construction and arrangement of parts the driving keys will present an adequate edge surface contact with the dressing pad to effectively retain and cause movement of the pad with the carrier as it performs its dressing reconditioning function.

As there are no other retaining means between the carrier and the dressing pad it is obvious that the latter may be easily and conveniently removed from the carrier for replacement and substitution if desired.

Figure 4:
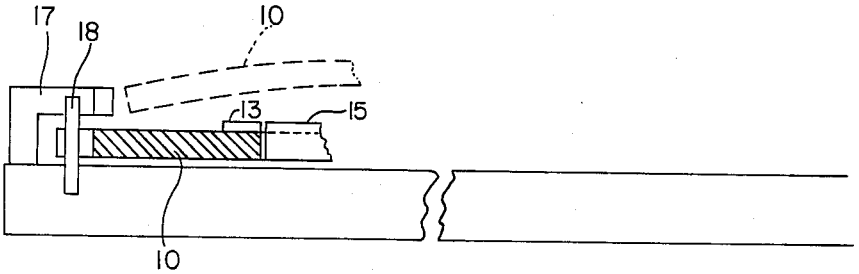
FIG. 4 is a fragmentary detailed sectional view of a modified machine to be dressed, together with the dressing fixture of this invention.

In FIG. 4 there is shown in an enlarged fragmentary view, a machine which has a gear pin cover 17 that extends over the top of the gear pins 18 both at the center hub and the outer fixed periphery. This cover is normally used to prevent the carrier from becoming dislodged or displaced during its rotation. Because the carrier 10 of this invention is made from a highly thin metallic material it can be readily flexed as shown in the drawing so as to be inserted beneath the pin covers into driving engagement with the pins 18 without the necessity of any tools or modification of the existing machine.

From the foregoing I have described a highly effective dressing fixture for dressing and reconditioning the surface of rotating platens. The dressing fixture may be placed upon a single surface or may be utilized in a machine that provides dual surfaces. In the latter both faces of the dressing pad will be exposed to the rotating surfaces to be dressed and will simultaneously recondition these surfaces. The fixture includes an extremely thin carrier provided with a series of driving keys that combine with the carrier to present sufficient edge contact with the dressing pad to cause the same to remain within the carrier and to be rotated thereby.

While I have illustrated and described the preferred form of construction for carrying my invention into effect, this is capable of variation and modification without departing from the spirit of the invention. I therefore, do not wish to be limited to the precise details of construction as set forth, but desire to avail myself of such variations and modifications as come within the scope of the appended claims.

Having thus described my invention, what I claim as new and desire to protect by Letters Patent is:

1. A fixture for dressing the surface of a circular platen mounted for rotation about a vertical axis comprising;

(a) a substantially flat flexible circular carrier formed from a relatively thin material adapted to be placed upon the surface of the circular platen to be dressed, (b) said carrier provided with a central opening for receiving a surface dressing member within its periphery, (c) a substantially flat surface dressing member having a thickness greater than said circular carrier and a configuration corresponding to said center opening and of a size equal to said center opening so as to occupy the entire center opening so that one of its flat surfaces has full facial engagement with the surface to be dressed, (d) said dressing member being made from a metallic material and having it's full flat surfaces formed to provide a rasp face, (e) means for rotating said carrier and said dressing member about its vertical axis independently of the rotation of the surface to be dressed, and (f) a series of retaining blocks mounted on the exposed surface of said carrier each providing a substantially straight edge adapted to contact the exposed edges of said dressing member for drivingly rotating said dressing member with said carrier as said carrier is rotated about its vertical axis relative to the surface being dressed.

* * * * *